US007815335B2

(12) United States Patent
Frick

(10) Patent No.: US 7,815,335 B2
(45) Date of Patent: Oct. 19, 2010

(54) UNI-PLANAR FOCAL ADJUSTMENT SYSTEM

(75) Inventor: Markus W. Frick, Reno, NV (US)

(73) Assignee: Night Operations Systems, Reno, NV (US)

( * ) Notice: Subject to any disclaimer, the term of this patent is extended or adjusted under 35 U.S.C. 154(b) by 297 days.

(21) Appl. No.: 12/012,443

(22) Filed: Jan. 31, 2008

(65) Prior Publication Data

US 2009/0207615 A1 Aug. 20, 2009

(51) Int. Cl.
*F21L 4/00* (2006.01)

(52) U.S. Cl. ..... 362/187; 362/285

(58) Field of Classification Search ..... 362/188, 362/285, 508, 289, 187, 288
See application file for complete search history.

(56) References Cited

U.S. PATENT DOCUMENTS 1,820,620 A * 8/1931 Jones ..... 362/188
4,947,291 A 8/1990 McDermott
5,072,347 A 12/1991 Brunson
5,142,458 A 8/1992 Brunson
5,144,207 A 9/1992 Brunson
5,228,770 A 7/1993 Brunson
5,359,779 A 11/1994 Polk et al.
5,461,552 A * 10/1995 Tillery ..... 362/188
5,604,406 A 2/1997 Gaus
5,630,661 A 5/1997 Fox
6,043,614 A * 3/2000 Tessnow et al. ..... 315/291
6,702,452 B2 3/2004 Jigamian et al.
6,761,467 B2 7/2004 Matthews et al.
6,896,392 B2 5/2005 Jigamian et al.
6,909,250 B2 6/2005 Jigamian et al.
6,984,061 B1 1/2006 Soderberg et al.

* cited by examiner

*Primary Examiner*—Gunyoung T Lee
(74) *Attorney, Agent, or Firm*—SilverSky Group LLC

(57) ABSTRACT

A uni-planar focal adjustment system involving no reflector housing rotation for use in high-intensity discharge (HID) lighting systems. A simple mechanical drive system allows a user to manually adjust the focal point by turning a focal adjustment ring, which in turn moves a HID lamp assembly back and forth along an optical axis relative to a stationary reflector. The system utilizes only linear motion along the optical axis and does not involve rotational reflector movement. The system allows for a significantly smaller reflector through-hole, which increases the percentage of HID generated light capable of being reflectively used in the focused light beam. Finally, the focal adjustment system allows for separation of the HID lamp assembly inductor/igniter coil from the remaining ballast circuit board components, thereby further improving heat management of the lighting system, while maintaining the optimum alignment of the lamp in regards to the parabolic optic and increasing light production efficiency.

17 Claims, 6 Drawing Sheets

UNI-PLANAR FOCAL ADJUSTMENT SYSTEM

BRIEF DESCRIPTION OF THE INVENTION

The present invention is directed to lighting systems and illumination devices, and more particularly to a focal adjustment system for handheld and/or portable lighting systems that produce a high intensity beam of light in the visible and infrared spectral regions that can be used for non-covert and ultra-covert operations. The disclosed uni-planar focal adjustment system does not involve rotating a reflector housing, but instead relies upon moving an HID lamp assembly along the optical axis relative to a stationary reflector housing.

CROSS-REFERENCES TO RELATED APPLICATIONS

Not Applicable.

STATEMENT AS TO THE RIGHTS TO INVENTIONS MADE UNDER FEDERALLY SPONSORED RESEARCH OR DEVELOPMENT

Not Applicable.

REFERENCE TO A "SEQUENCE LISTING," A TABLE, OR A COMPUTER PROGRAM LISTING APPENDIX SUBMITTED ON A COMPACT DISK

Not Applicable.

BACKGROUND OF THE INVENTION

High intensity discharge (HID) lamps include mercury vapor, metal halide, high and low pressure sodium, and xenon short-arc lamps. HID lamps produce light by generating an electric arc across two spaced-apart electrodes housed inside a sealed quartz or alumina arc tube filed with gas or a mixture of gas and metals. The arc tube is typically filled under pressure with pure xenon, a mixture of xenon-mercury, sodium-neon-argon, sodium-mercury-neon-argon, or some other mixture such as argon, mercury and one or more metal halide salts. A metal halide salt (or metal halide) is a compound of a metal and a halide, such as bromine, chlorine, or iodine. Some of the metals that have been used in metal halide lamps or bulbs include indium, scandium and sodium. Xenon, argon and neon gases are used because they are easily ionized, produce some level of immediate light, and facilitate the striking of the arc across the two electrodes when voltage is first applied to the lamp. The heat generated by the arc then vaporizes the sodium, mercury and/or metal halides, which produce light as the temperature and pressure inside the arc tube increases.

Since HID lamps are negative resistance devices, they require an electrical ballast to provide a positive resistance or reactance that regulates the arc current flow and delivers the proper voltage to the arc. Some HID lamps, called "probe start" lamps, include a third electrode within the arc tube that initiates the arc when the lamp is first lit. A "pulse start" lamp uses a starting circuit referred to as an igniter, in place of the third electrode, that generates a high-voltage pulse to the electrodes to start the arc. Initially, the amount of current required to heat and excite the gases is high. Once the chemistry is at its "steady-state" operating condition, much less power is required, making HID lamps more efficient (producing more light with less energy over a long period of time) than filament based lights.

The majority of light generated by a short gap HID lamp is produced by a small line source of plasma. This relatively small light source enables the output of the HID lamp to be more easily focused into an intense, narrow beam than many other light sources. HID lamps also produce high heat levels close to the lamp. A concave (parabolic or elliptical) shaped reflector, with a through-hole in the bottom through which the HID lamp is inserted, is used to focus the light. A "through-hole" is the hole cut in the bottom of the reflector that allows the HID lamp to protrude into the reflector. Most reflectors are formed from polished aluminum, which is sometimes coated with other reflective materials. The design of the reflector, and in particular the size and shape of the through-hole, has a great effect on the efficiency of the entire electro-optical system. Since heat from the lamp can be transferred to the reflector and through the through-hole and into the ballast assembly, reducing the through-hole and reducing a users need to touch the reflector housing (which may be quite hot), has added importance in HID lamps.

Handheld searchlights and portable lights using HID lamp light production are powerful tools that may be used in both covert and non-convert operations. An ability to manually adjust the focus of such a searchlight during use can be critical. The act of focusing involves adjusting the beam of light produced. Depending upon the focal adjustment made by a user, the beam may be adjusted from a wide beam that will travel a certain distant to a narrow beam that will travel substantially further but obviously not light up as much area. Of course, it may be possible to adjust the light beam continuously, meaning that the searchlight may be adjusted to any point in between the widest beam capable of being produced and the narrowest beam capable of being produced. Focal adjustment is therefore an important feature in a heavy duty or professional handheld/portable searchlight system.

The focus of a searchlight or flashlight is generally adjusted by moving the reflector relative to the HID lamp, along the optical axis. Positioning a HID lamp relatively far into a reflector, meaning that the electric arc is created closer to the searchlight's outer lens and further from the searchlight's ballast, will create a light beam that is wider but travels a shorter distance. On the other hand, positioning a HID lamp shallow into a reflector, meaning that the electric arc is created further from the searchlight's outer lens and closer to the searchlight's ballast, will create a light beam that is narrower but travels a longer distance. Traditionally, the relative position of the HID lamp has been adjusted by moving the reflector along the optical axis while keeping the HID lamp rigidly in place. This is usually accomplished by designing the reflector to attach to the remaining searchlight components by screwing onto threaded stock. Such a design means that if a user either screws the reflector tighter or unscrews the reflector looser, the reflector will move along the optical axis and thus change its position relative to the HID lamp.

There are many drawbacks to relying on screwing the reflector in and out of threaded stock in order to adjust focus. It is possible for a user to accidently unscrew the reflector completely, so that the reflector becomes separated entirely from the remainder of the searchlight. User safety is also at issue because traditional designs ask a user to manually handle and/or rotate the reflector itself in order to screw the reflector in and out of the threaded stock. The reflector housing is subject to intense heat as it reflects the light produced by the HID lamp assembly and can become quite hot during use. Physically handling such a hot reflector can be dangerous. Furthermore, a rotating reflector obviously changes the angular orientation of the reflector relative to the optical axis and relative to the user. If a user intends to switch out the searchlight lens or filter attachment being used and replaces it with another, the user may need to quickly locate the lens/filter attachment points along the rim of the reflector and then detach the current lens/filter. This may prove difficult if the orientation of the attachment points constantly change with every focal adjustment. Additionally, a rotating reflector housing necessarily requires a relatively large through-hole in order to allow the reflector to fully rotate about the HID lamp. This is because a HID lamp's cross-section is not circular —it has an assist, and/or frame, wire that protrudes from the outer shroud of the lamp glass —meaning that a through-hole must be cut to accommodate the assist wire, creating a significantly larger through-hole. A relatively larger through-hole is detrimental to both light beam production (because a significant amount of surface area from the optic's highly reflective, and most meaningful portion of the, parabola has been removed) and heat management (because more heat is allowed to travel into the ballast assembly through the larger diameter hole instead of being reflected towards the lens and ultimately the outside atmosphere).

Heat management suffers in the traditional design as well because the traditional design necessitates a complete separation of the light-producing module from the reflector module, i.e., the reflector is a completely separate component from the ballast, the HID lamp being rigidly attached to the ballast. Attaching the HID lamp to the ballast means that the HID lamp inductor/igniter coil is positioned on the same circuit board as the other ballast circuit components. Such a design results in intense heat production on the ballast circuit board which reduces efficiency and is not ideal. Furthermore, the high voltage inductor/igniter coil creates a significant EMF (electromagnetic field) and EMI (electromagnetic interference) field which can prove detrimental to the operation and reliability of other sensitive circuit board components; not to mention the increased threat of arcing caused by placing this high voltage unit next to other conductive components. A more ideal design would separate the HID lamp inductor/igniter coil from the ballast components to reduce ballast area heat production while increasing the ballast's reliability by separating high and low voltage segments.

Additional problems can arise when focal adjustment relies upon a reflector moving along threaded stock. In such a design, the reflector threads must be aligned perfectly upon the handle/ballast threads or upon whichever component the reflector threads mate. If the angle of the components is off when they are screwed together, the angle of the reflector will be off relative to the HID lamp, and therefore the light beam produced will be deficient. Such a misalignment may occur in production, either when the threads are cut or when the components are fitted together; may occur when the lamp is improperly seated askew in its socket; or may occur during normal use when a user attempts to adjust focus or when a user attempts to refit the reflector and the handle/ballast after taking them apart. Threaded components are easily misaligned and so such a design is clearly not ideal.

DETAILED DESCRIPTION OF THE INVENTION

Figure 1B:
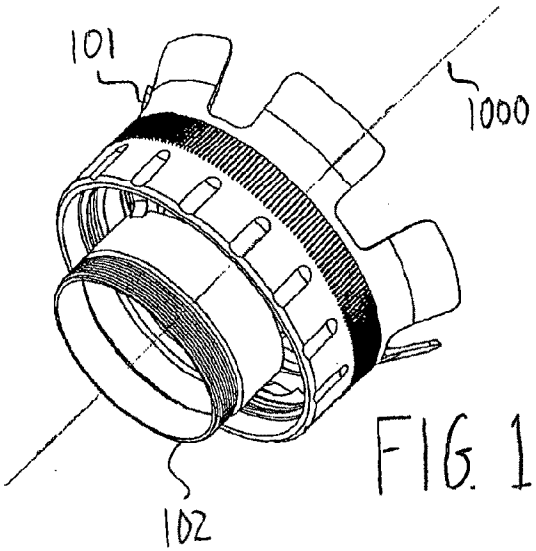
FIGS. 1A, 1B and 1C show various components of the uni-planar focal adjustment system, in exploded, assembled isometric, and cross-sectional assembled views, respectively.

The present invention is directed to a uni-planar focal adjustment system to be used in combination with various other elements in a HID searchlight system to produce a high intensity beam of light in the visible and infrared spectral regions that can be used for non-covert and ultra-covert operations.

A uni-planar focal adjustment system, which may also be referred to as a mono-planar focal adjustment system, may provide several benefits over traditional focal adjustment systems. A key feature of the disclosed invention is that the searchlight's reflector does not change orientation when a user adjusts the focus of a searchlight equipped with the uni-planar focal adjustment system. As discussed above, traditional focal adjustment systems operate by rotating the reflector, and possibly other additional components, on threaded stock about the optical axis. As the reflector rotates on the threaded stock, its lateral position relative to the lamp changes and thus the focus is adjusted. Thus traditional focal adjustment method involves changing the orientation of the reflector in order to adjust focus. The present invention discloses a focal adjustment system that allows for adjustment of the lateral position of the lamp without a change of reflector orientation.

An ability to adjust focus without having to rotate a searchlight's reflector has many benefits. In searchlights wherein focal adjustment is facilitated by a reflector moving along the optical axis by rotating on threaded stock, it is conceivable that the reflector will accidentally unscrew or separate from the ballast and/or the lamp assembly. Such possibility of accidental separation would leave the entire searchlight inoperable for at least a short period of time and, while obviously undesirable during casual use, a moment of inoperability is unacceptable during a covert operation. By avoiding a reflector that rotates on threaded stock, such moments of inoperability can be avoided or reduced. Another drawback to a rotating reflector is that while the reflector rotates about the optical axis, the lens also rotates and the outside surfaces of the reflector also rotate. This means that any accessories, such as additional lens attachment mechanisms and/or filter attachment mechanisms, rotate about the optical axis during focal adjustment. If and when such attachment mechanisms rotate, their orientation changes and a user may then be in a position of fumbling to attach or detach a lens or filter, costing valuable time and causing distraction and unwanted noise.

In the uni-planar design herein disclosed, the reflector does not rotate about the optical axis. Any user accessories attached to the outside of the reflector remain oriented in a constant position relative to the optical axis, making user actions such as attaching or detaching lens and/or filters more easily and quickly accomplished. For example, a visible light blocking filter may attach over the searchlight's lens at three attachment points on the outer perimeter of the reflector, and the attachment points may be evenly spaced every 120 degrees along the circular perimeter of the reflector. A covert user would be able to familiarize himself/herself with the location of the consistently oriented attachment points and would then be able to easily attach the visible light filter quickly and quietly. But if the reflector rotates during focal adjustment, then the three attachment points would also rotate, forcing a user to have to find them on the fly if he/she has previously adjusted the searchlight's focus. Thus, a constant reflector orientation is desirable.

A further benefit of the herein disclosed focal adjustment system is that it does not require a user to handle hot reflector surfaces in order to adjust focus. When focal adjustment relies on a user rotating the entire reflector module about the optical axis, the user must necessarily grab hold of the outer surface of the reflector with his or her hands. The disclosed uni-planar focal adjustment system allows for focal adjustment without need of physically touching a hot reflector module.

The disclosed uni-planar focal adjustment system provides another benefit in improved heat management throughout an entire searchlight system. As will be described in greater detail below, the HID lamp assembly may be secured to a focal adjustment ring and reflector housing, instead of being secured to a ballast as in the traditional design. The main benefit of this is that the lamp assembly, especially the HID lamp inductor/igniter coil, may be separated from other circuit board components. The HID lamp inductor/igniter coil may in some circumstances be required to produce up to 25,000 volts of electricity to aid in HID lamp ignition, an extremely high voltage. If this HID lamp inductor/igniter coil is positioned on the same circuit board as other necessary ballast components, the other components may overheat and begin to degrade and work inefficiently or stop working.

By securing the HID lamp assembly (including the HID lamp inductor/igniter coil) to the reflector housing instead of the ballast, the coil may be separated from other circuit board components. In this way, the ballast circuit board need not be subjected to the intense heat generated by the HID lamp inductor/igniter, and thus function much more efficiently. At the same time, the reflector housing and adjacent components may be designed so as to whisk away the tremendous heat generated by the HID lamp inductor/igniter coil. Thus, as will be described in greater detail below, the uni-planar design herein disclosed allows for greatly improved heat management of an entire searchlight system.

There are additional heat management benefits from the disclosed uni-planar focal adjustment system. Most focal adjustment systems that utilize a rotating reflector are forced to design their reflector with a relatively large diameter through-hole through which the lamp module protrudes. The through-hole in these traditional designs is necessarily large because it must be large enough to allow the reflector to spin freely about the lamp module. HID lamp modules are in many cases comprised of a cylindrical shroud made of a glass, ceramic or quartz, in which gases, metals, and/or other chemicals are enclosed, and a relatively thin metal wire running parallel to the outside of the cylindrical shroud, the wire referred to as a starting assist wire or a lamp frame wire. In these traditional designs, the reflector through-hole diameter necessarily must be increased to such an extent as to accommodate the assist wire/frame wire as the reflector rotates around the optical axis. For example, a lamp's quartz outer shroud, measured at diameter of the cylindrical structure, may have a radius of only 4 mm from the optical axis or centerline, while the parallel assist wire may stand off from the outer shroud an additional 3 mm or 4 mm, effectively doubling the radius from the optical axis or centerline. Therefore, if the through-hole, at the bottom of the reflector's parabola (ballast connection end), is to accommodate full rotation about the lamp module, the through-hole must be even larger in order to allow for clearance of both, the quartz outer shroud and assist/frame wire.

Such a design dramatically reduces a reflector module's efficiency because the optic's highly reflective parabolic surface area is decreased and light's radiant energy that would otherwise be redirected into the beam is lost by instead passing through the reflector's through-hole to the lamp base and ballast circuitry. In the disclosed uni-planar focal adjustment system, however, the reflector module does not have to rotate about the optical axis. As a result the through-hole can be cut much tighter to the true lamp outer shroud diameter, with only an additional relatively small "mouse hole" cut-out for the assist/frame wire. This allows, in essence, the formation of a much smaller diameter "key hole" at the bottom of the reflector.

Furthermore, the overall heat management of an assembled searchlight with the larger full assist wire radius cutout is greatly compromised. Radiant heat carried by the light rays is not being redirected away from the lamp base and adjacent electronic circuitry, but instead passes through the larger diameter through-hole, degrading the complete searchlight system's efficiently. By keeping the focal-related travel in one plane and/or axis, the reflector through-hole diameter can be reduced by 50% or more because a precisely cut key hole can be employed that accurately traces the lamp module's cross-sectional profile. This adds valuable surface area to the highly reflective portion of the parabolic optic. Such a smaller and more tightly cut through-hole significantly improves both the reflection of light and the overall system's heat management efficiency.

Figure 1C:
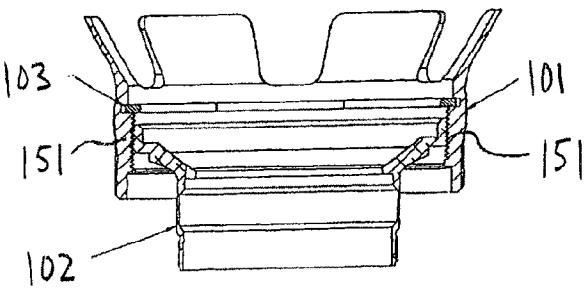
Figure 1A:
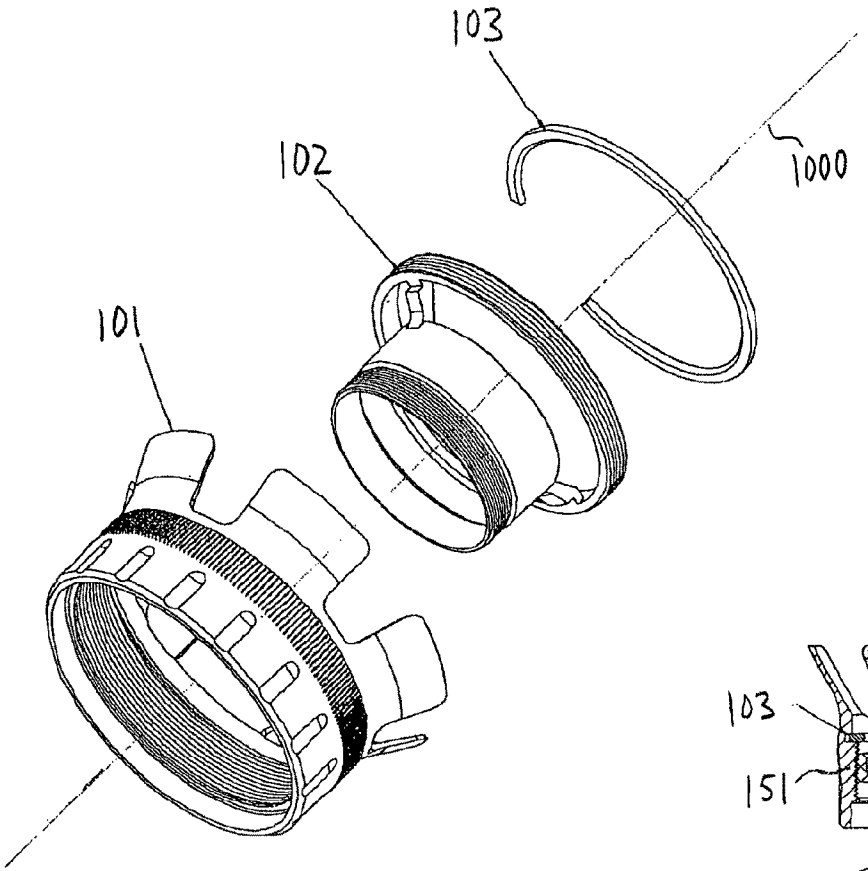

An embodiment of a uni-planar focal adjustment system involves a HID lamp module capable of moving forwards and backwards along a searchlight's optical axis, combined with a stationary reflector module and a stationary ballast module. The system has tremendous benefits over traditional focal adjustment systems, but mechanically is relatively simple and could be implemented in a number of ways. One exemplary system design, illustrated in FIGS. 1 through 5, is comprised of a focal adjustment ring 101, a lamp traveler 102, a retaining snap ring 103, and a reflector housing 204. Focal adjustment ring 101 may be metal (aluminum alloy, for example), plastic, or a composite material, and is designed to be rotated by a user placing a thumb and a forefinger on the outside of the ring and applying manual rotational pressure. Focal adjustment ring 101 may have threads cut into the inside surface, as can be seen in FIG. 1, to interact with complimentary threads cut on the upper, outside surface of lamp traveler 102. Lamp traveler 102 may also be metal, plastic, or a composite material, and is designed to have a hollow body within which an inductor/igniter coil and wiring of the HID lamp assembly reside. The lamp traveler 102 may have a wider top portion threaded to interact with threads cut into the inside of focal adjustment ring 101. Retaining snap ring 103 may be metal, plastic, or a composite material, and is designed to snap into place in the upper-most thread of focal adjustment ring 101's threading. Each component will be described further below.

Figure 2B:
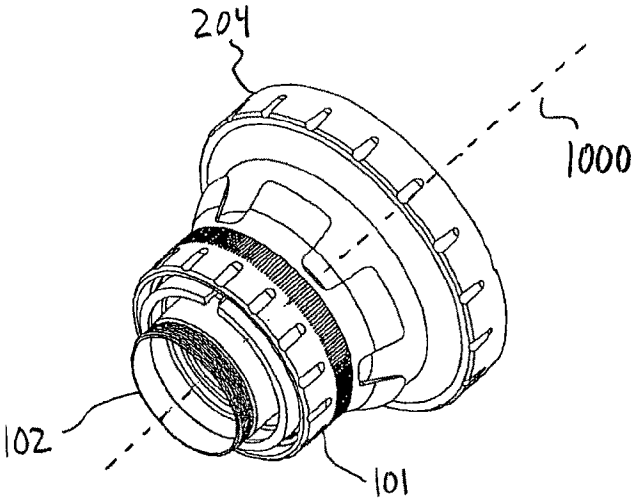
FIGS. 2A, 2B and 2C show various components, including a reflector not shown in FIG. 1, of the uni-planar focal adjustment system, in exploded, assembled isometric, and cross-sectional assembled views, respectively.
Figure 2C:
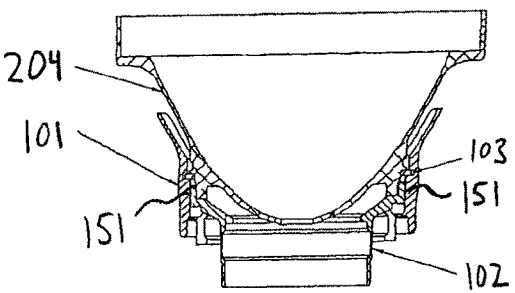
Figure 2A:
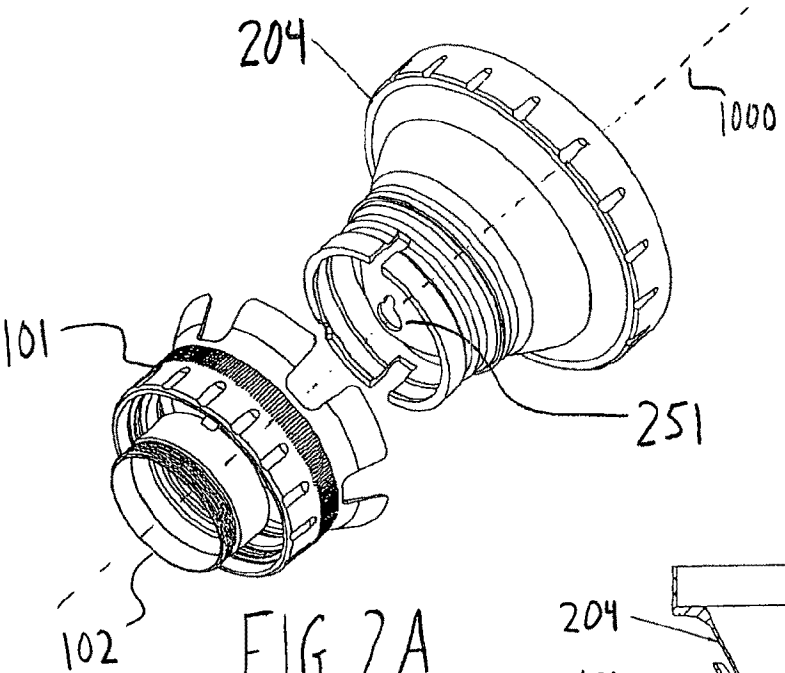

Although not shown in FIG. 1 or 2 (but which may been seen fully assembled in FIG. 3), lamp traveler 102 is designed to hold a HID lamp assembly 301. The HID lamp assembly 301 may be a cylindrical unit, with two electrical contacts protruding from the bottom surface and the HID lamp's glass shroud and assist wire protruding from the top surface. The cylindrical unit would fit within the hollow body of the lamp traveler 102.

The components are arranged so that when a user turns focal adjustment ring 101 about the reflector housing 204, the lamp traveler 102 moves back and forth along optical axis 1000. The movement of the lamp traveler 102 facilitates focal adjustment in that a HID lamp, attached rigidly to lamp traveler 102, is moved further into the reflector or pulled further out of the reflector, along optical axis 1000. Given the parabolic configuration of the internal surface of the reflector housing, it is not necessary to move the HID lamp very far relative to the reflector to adjust the focus of the searchlight from a narrow beam to a broad beam.

Focal adjustment ring 101 and lamp traveler 102 interact via threading cut on the inside of focal adjustment ring 101 and on the outside of lamp traveler 102, and are meant to be fitted together. Looking at the two components in a vacuum, if focal adjustment ring 101 is held stationary, lamp traveler 102 may be spun on the threads and therefore move back and forth along optical axis 1000. When the components are positioned in place on the reflector housing 204, as may be seen in FIGS. 2 and 3, the design of reflector housing 204 allows focal adjustment ring 101 to rotate around reflector housing 204, but does not allow focal adjustment ring 101 to move along optical axis 1000 relative to reflector housing 204. This means that when a user rotates focal adjustment ring 101 around reflector housing 204, lamp traveler 102 moves along optical axis 1000 in response. As lamp traveler 102 moves along optical axis 1000, the HID lamp assembly moves along optical axis 1000, thereby adjusting the focus.

Focal adjustment ring 101 is illustrated in FIGS. 1 through 5. A focal adjustment ring to be used in the uni-planar focal adjustment system may be made from practically any material: it could be metal, such as aluminum; it could be some sort of hard plastic; or it could be a composite such as a carbon-fiber material. An example of an embodiment with beneficial characteristics can be made by machining a focal adjustment ring from an aluminum alloy, and then anodizing the machined part. Aluminum alloy is a desirable material because it has relatively high strength, low weight, and conducts heat well, meaning that a focal adjustment mechanism made of aluminum alloy will tend to whisk away heat generated by the HID lamp assembly (which as discussed is positioned within the focal adjustment ring) as opposed to retaining or insulating the large amount of heat produced.

The machined aluminum alloy part may be anodized in order to increase corrosion resistance and wear resistance. This is important because the focal adjustment ring is one component of the uni-planar focal adjustment system that is manually handled by a user to adjust focus; a user rotates the focal adjustment ring with his or her thumb and forefinger. The focal adjustment ring may be cut with threads on the inside in order to interact with complimentary threads cut on the lamp traveler 102. The threads can be of any sort known in the art, but may be most advantageously cut with quad-leads so that lamp traveler 102 moves further along optical axis 1000 for each focal adjustment ring rotation than would be possible with single or dual-lead threads. This allows the user to adjust the focus from narrow beam to broad beam with a relatively small rotation (180 degrees, or a half turn) of the focal adjustment ring 101. The focal adjustment ring 101 may be machined so that fans protrude from the top of the ring, as is illustrated in FIGS. 1 through 5, so that when fitted onto the reflector housing 204, a user's fingers or thumb do not slip into contact with the reflector housing 204, which may be quite hot during searchlight use. User safety is greatly improved over traditional focal adjustment with the herein disclosed design because a user need not physically touch the hot reflector housing.

Lamp traveler 102 is illustrated in FIGS. 1 through 5. A lamp traveler to be used in the uni-planar focal adjustment system may be made from practically any material: it could be metal, such as aluminum; it could be some sort of hard plastic; or it could be a composite such as a carbon-fiber material. An example of an embodiment with beneficial characteristics can be made by machining a lamp traveler from an aluminum alloy. As discussed above, aluminum alloy is a desirable material because it will tend to whisk away heat generated by the HID lamp assembly as opposed to retaining or insulating the large amount of heat produced.

The lamp traveler may be cut with threads on the outside of its upper, widest portion, as can be seen most clearly in FIG. 1. These upper threads interact with threads cut into the inside of focal adjustment ring 101, and may be cut in any manner known in the art. The lamp traveler may be machined so that the threaded upper portion is only attached to the lower hollow body portion via two arms, as can be seen in the figures. The two arms may each be machined to different thicknesses or widths (asymmetrical geometry) so that when assembled with reflector housing 204, the two arms may only fit one way within corresponding notches machined into reflector housing 204. The aims of lamp traveler 102 and the corresponding notches on reflector housing 204 can be seen in FIG. 5.

The purpose of lamp traveler 102 is to carry HID lamp assembly 501 back and forth along optical axis 1000 to adjust focus. The body of lamp traveler 102, therefore, may be hollowed-out to accommodate HID lamp assembly 301. HID lamp assembly 301's inductor/igniter coil and other wiring may be contained within the hollow body of lamp traveler 102, while the HID lamp assembly's glass shroud and assist wire protrude upwards through the top end of lamp traveler 102, so that the glass shroud and assist wire may protrude into the reflector housing 204 when fully assembled. The components may be seen assembled in FIG. 3.

In order to secure HID lamp assembly 301 within lamp traveler 102, lamp traveler 102 may be cut with threads on the outside of its lower hollow body portion, as is seen in FIGS. 1 through 5. End cap 502 may be made with the same material as lamp traveler 102 and is cut with threads complimentary to the threads cut in the lower hollow body portion of lamp traveler 102. The end cap 502 screws onto lamp traveler 102 after HID lamp assembly 204 is positioned within the hollow body portion of lamp traveler 102 in order to secure the HID lamp assembly in place without the use of tools, (by hand) in a short amount of time. This assembly allows for very rapid field replacement of the lamp, without tools, while guaranteeing the continued accuracy of the optical alignment of the lamp/reflector uni-planar focal mechanism.

Snap ring 103 is illustrated in FIGS. 1 through 3 and FIG. 5. A snap ring to be used in a uni-planar focal adjustment system may be made from practically any material, including aluminum, plastic or carbon-fiber materials. An example of an embodiment with beneficial characteristics can be made by machining a snap ring from an aluminum alloy. The snap ring is machined to fit within the upper most thread of focal adjustment ring 101. The snap ring has two purposes in the focal adjustment system: (1) to partially constrict the movement of lamp traveler 102 so that the lamp traveler may not be screwed completely out of the threading, and (2) to fully restrict the movement of the focal adjustment ring along optical axis 1000 so that when focal adjustment ring 101 is rotated, it itself does not move, but rather lamp traveler 102 moves.

The first purpose is met because the snap ring sits directly in the upper most thread of focal adjustment ring 101. Thus the threading of lamp traveler 102 is unable to screw into the upper most thread of focal adjustment ring 101, and so lamp traveler 102 is restricted from moving too far upwards along optical axis 1000. The second purpose is met because after snap ring 103 is placed within focal adjustment ring 101, the assembly is placed onto reflector housing 204 and snap ring 103 also snaps into place on a ridge machined into the outer surface of reflector housing 204, as may be seen in the assembled cross-sectional drawings of FIGS. 1 through 3.

Reflector housing 204 is illustrated in FIGS. 1 through 5. The design of a reflector housing is complex and most considerations are beyond the scope of this patent. The reflector housing outside surface, however, may be designed with the herein disclosed uni-planar focal adjustment system in mind. Reflector housing 204 may be made from practically any material: it could be metal, such as aluminum; it could be some sort of hard plastic; or it could be a composite such as a carbon-fiber material. A reflector housing formed from an aluminum alloy with an anodized exterior surface is preferable. A ridge may be machined into the outer surface of reflector housing 204 so that snap ring 103 may secure focal adjustment ring 101 in place along optical axis 1000 while still allowing focal adjustment ring 101 to rotate about the reflector housing. This ridge can be seen in the assembled cross-sectional drawings of FIGS. 1 through 3. Reflector housing 204 may also be machined with two notches in the protruding bottom portion, as can be seen in the exploded isometric view of FIG. 2, in FIG. 4, and in FIG. 5. The arms of lamp traveler 102 are placed into the two notches in reflector housing 204. In this way, lamp traveler 102 is restricted from rotating when a user rotates focal adjustment ring 101—so that instead of rotating, the lamp traveler 102 moves back and forth along optical axis 1000 in one plane. A through-hole may also be cut through the bottom portion of reflector housing 204. The through hole will be discussed below.

Figure 3:
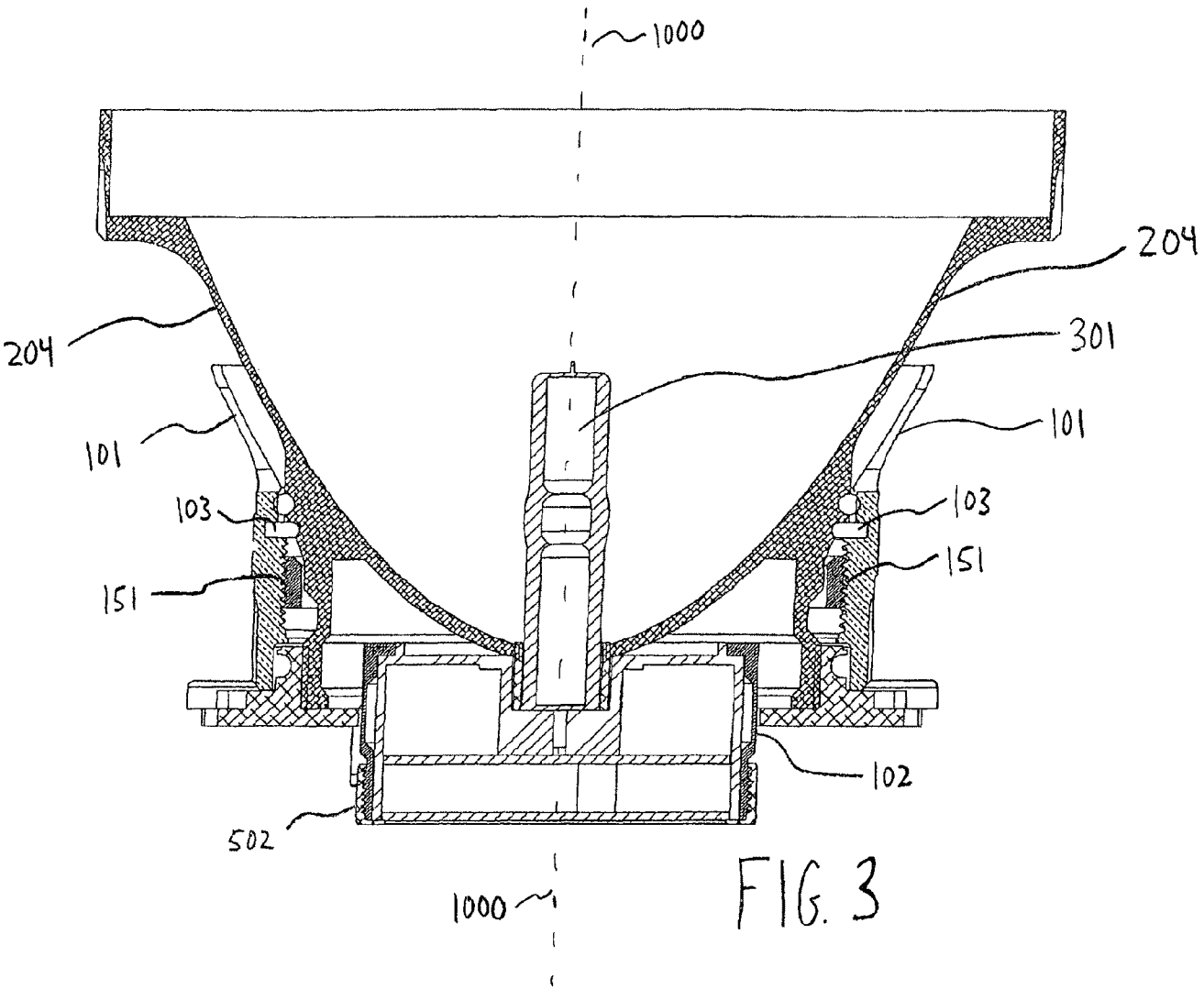
FIG. 3 shows various components, including a HID lamp assembly, of the uni-planar focal adjustment system, in an assembled cross-sectional view.
Figure 4:
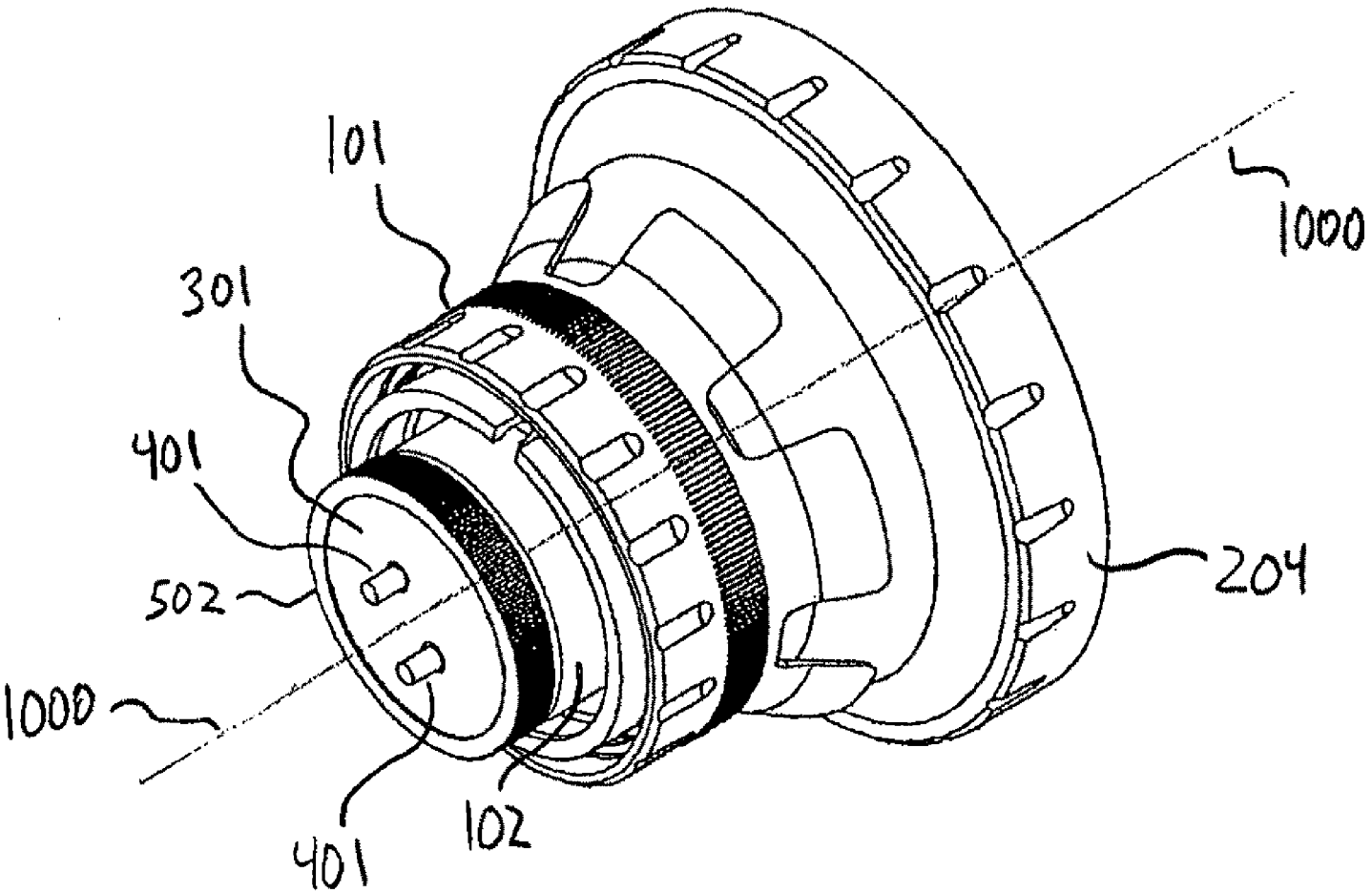
FIG. 4 shows various components, including electrical contacts, of the uni-planar focal adjustment system, in an assembled isometric view.
Figure 5:
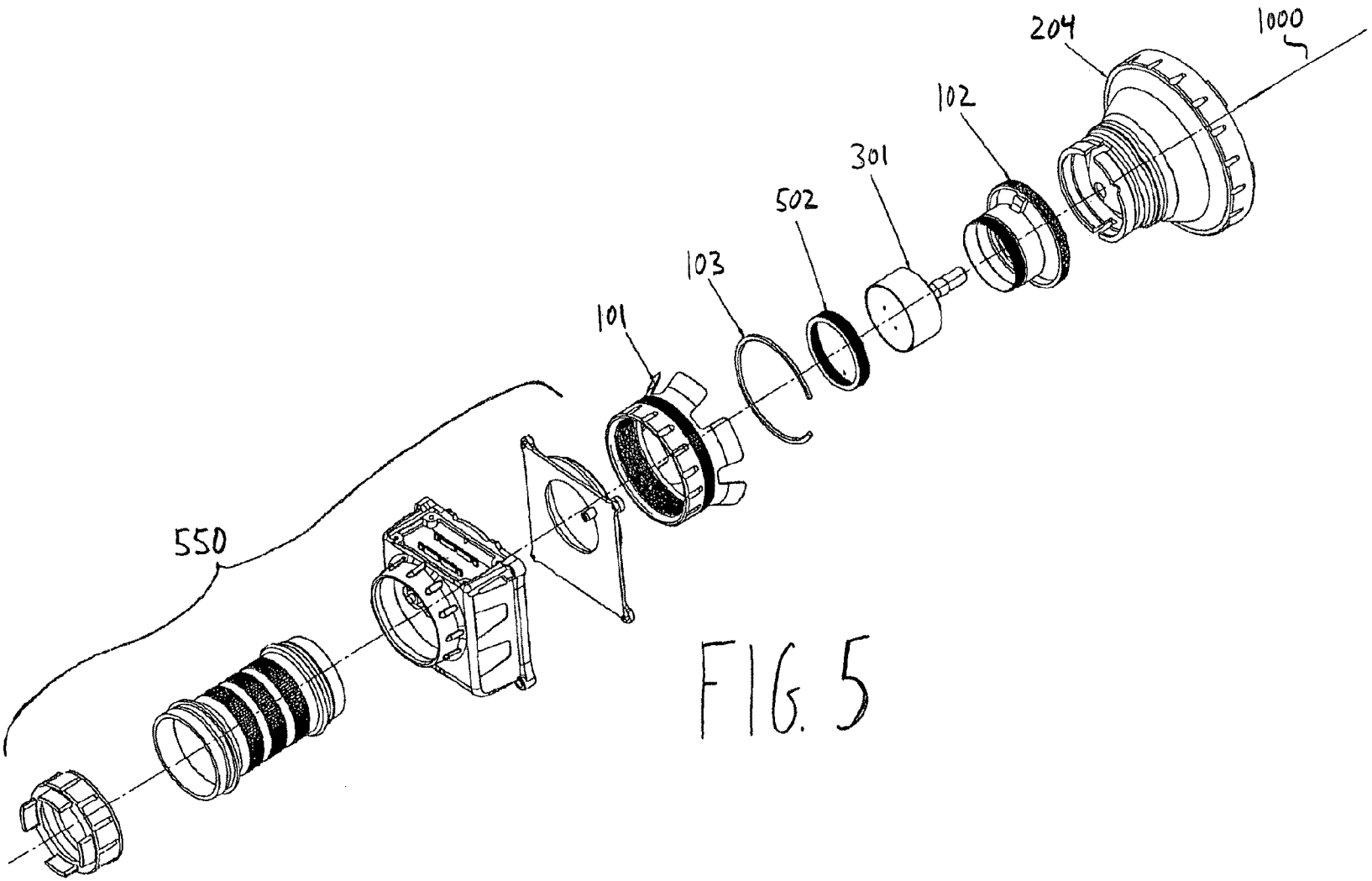
FIG. 5 shows various components, including ballast assembly components, of the uni-planar focal adjustment system in an exploded isometric view.

In order to facilitate focal adjustment, lamp traveler 102 is designed to move in both directions along optical axis 1000. As is illustrated in FIG. 3, HID lamp assembly 301 is rigidly secured within lamp traveler 102 by end cap 502 so that the glass shroud and assist wire protrude upwardly into reflector housing 204 while the lamp assembly's inductor/igniter coil and wiring are contained within the hollow body of lamp traveler 102. Lamp traveler 102 and HID lamp assembly 301 are not attached directly to reflector housing 204, but instead lamp traveler 102 is positioned adjacent to reflector housing 204 so that HID lamp assembly 301 protrudes through a through-hole cut in the bottom of reflector housing 204. As can be seen at point 151, threads cut into the outside of lamp traveler 102 and threads cut on the inside of focal adjustment right 101 interact to facilitate the movement of lamp traveler 102 along optical axis 1000. As focal adjustment ring 101 is rotated by a user, lamp traveler 102 does not rotate and remains constantly oriented. Rotation of focal adjustment ring 101 instead advances or retracts lamp traveler 102, FIG. 4 illustrates one example of how lamp traveler 102 may interact with a searchlight's ballast components. As discussed, lamp traveler 102 is capable of moving along optical axis 1000 in order to facilitate focal adjustment. HID lamp assembly 301 secured within lamp traveler 102 must remain powered by a power supply so that the HID lamp assembly may be initially lit and then continually supplied with electrical power during operation, as is known by those skilled in the art. Electrical contacts 401 are one example of how HID lamp assembly 301 connects to the ballast components or other power supply modules.

The contacts 401 may be long enough so that when focal adjustment ring 101 (not shown in FIG. 4) is adjusted so that HID lamp assembly 301 is at its closest point to the searchlight's lens, the contacts 401 are in contact with remaining ballast components. The electrical contacts 401 may be spring-loaded, so that as lamp traveler 102 retracts towards the ballast assembly 550 and away from the lens, the electrical contacts remain connected to the ballast power supply while allowing the lamp traveler 102 to move closer to the ballast assembly 550 along optical axis 1000. In other words, electrical contacts 401 may be able to retract into HID lamp assembly 301 to accommodate lamp traveler 102's movement towards ballast assembly 550, while still remaining connected.

Figure 6C:
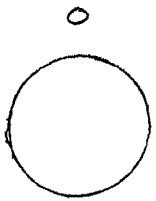
FIGS. 6A, 6B, 6C and 6D show various views of a HID lamp assembly, including a simplified cross-sectional view illustrating the HID lamp assembly's cross-sectional shape, and a simplified view of a reflector cut with a key-hole shaped through-hole.

One of the major benefits to utilizing a uni-planar focal adjustment system is that, as discussed above, such a system allows for a significantly smaller diameter through-hole cut through a searchlight's reflector. As is illustrated in FIGS. 2 and 6, a through-hole 251 cut through a reflector housing 204 may be cut in a key-hole shape, following an outline of a cross-sectional view of the glass shroud and assist wire portion of HID lamp assembly 301. As discussed, and as may be seen in FIGS. 6A and 6B, HID lamp assemblies include a frame or assist wire protruding from the outer shroud of the HID lamp glass shroud. FIG. 6C is a simplified cross-sectional view of HID lamp assembly 301, illustrating the assembly's cross-sectional shape. One example of such a key-shaped through-hole can be seen at through-hole 251; in both FIGS. 2 and 6D. Through-hole 251 is only an example and is not draw to scale.

Figure 6D:
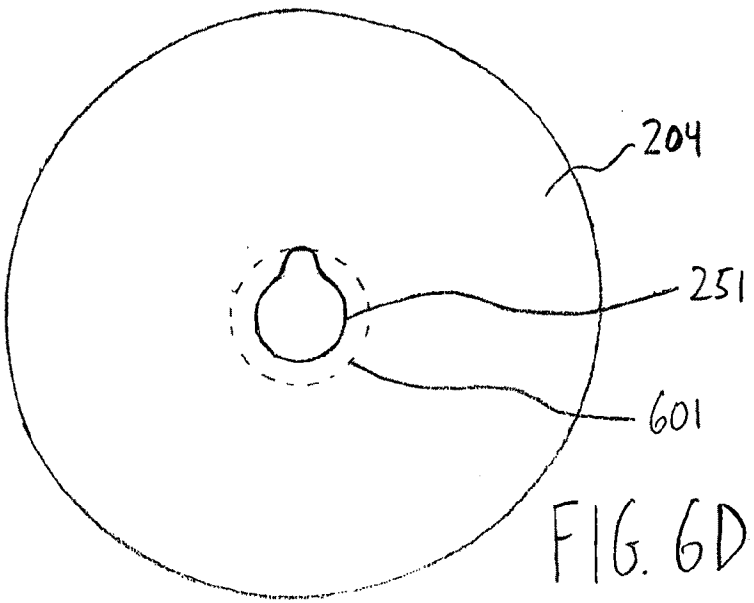
Figure 6A:
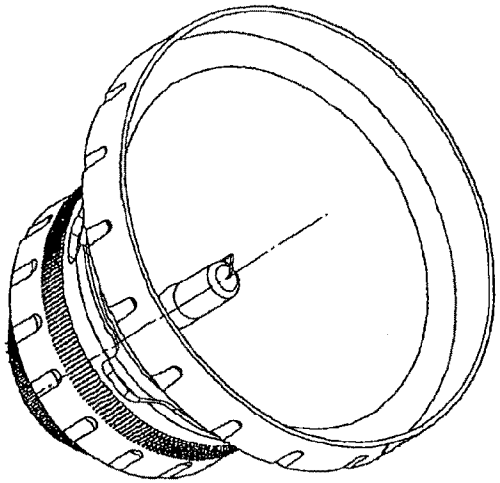
Figure 6B:
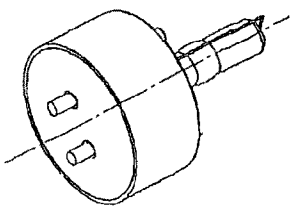

A reflector for a searchlight utilizing the herein disclosed uni-planar focal adjustment system would work properly with practically any shaped through-hole, including a traditionally shaped through-hole cut approximately as a circle. FIG. 6D illustrates the difference between a key-hole shaped through-hole as suggested by this disclosure and a traditionally shaped circular (and larger) through-hole. As discussed, such round and relatively larger through-holes (larger because the entire through-hole is cut at a diameter slightly greater than the diameter of the protruding assist wire, as opposed to a key-hole shaped through-hole which is cut at a smaller diameter except for a small portion cut at the larger assist wire diameter) are not optimum for several reasons. A uni-planar focal adjustment system equipped searchlight will, however, be at least functional with a round and relatively larger through-hole. But for optimum light reflection and heat management, a through hole should be cut as small as possible and as tight-fitting as possible to the cross-sectional shape of an accompanying HID lamp assembly, as illustrated in FIG. 6D.

While the present invention has been illustrated and described herein in terms of a preferred embodiment and several alternatives associated with a handheld HID lighting system for use in visible and covert operations, it is to be understood that the various components of the combination and the combination itself can have a multitude of additional uses and applications. For example, the uni-planar focal adjustment system herein disclosed can easily be adapted to other types of searchlights or flashlights. It could be utilized in light-weight or commercial flashlights for use in homes by average consumers. It could be utilized in combination with other types of light generation, from incandescent bulbs to light emitting diodes (LEDs). It could also be utilized in lighting systems mounted to a variety of non-handheld vehicles or structures. Lighting systems incorporating the herein disclosed uni-planar focal adjustment system may be used in practically any conceivable operation, from heavy duty and covert to routine or mundane, including but not limited to commercial, scientific, law enforcement, security, and military-type operations. Accordingly, the invention should not be limited to just the particular description and various drawing figures contained in this specification that merely illustrate a preferred embodiment and application of the principles of the invention.

What is claimed is:

1. A focal adjustment system for use in a lighting system, comprising:

a lamp assembly operative to be moved along an optical axis relative to a reflector in a fixed position to facilitate a focal adjustment of the lighting system;

a focal adjustment ring changing the focal adjustment through rotation of the focal adjustment ring relative to a fixed rotational position of the lamp assembly, the focal adjustment ring positioned around a portion of the reflector; and a lamp traveler positioned between the focal adjustment ring and the reflector, wherein the lamp traveler includes an upper body portion for mating with the focal adjustment ring and a lower body portion for carrying the lamp assembly, the upper body portion being connected to the lower body by two or more arms.

2. The system as recited in claim 1, wherein the reflector forms a through-hole for receiving a lamp of the lamp assembly, wherein the lamp includes a glass shroud having a first diameter and an assist wire having a second diameter outside of the glass shroud, wherein the through-hole includes a substantially circular shaped portion of a third diameter slightly greater than the first diameter and an adjoining portion of a fourth diameter slightly greater than the second diameter.

3. The system as recited in claim 1, wherein the lamp assembly includes a glass shroud and an assist wire external to the glass shroud having a combined first diameter, and wherein the reflector forms a through-hole having a second diameter smaller than the first diameter.

4. The system as recited in claim 1, wherein the lighting system includes a ballast circuit having a circuit board, wherein the lamp assembly includes an inductor coil, and wherein the lamp assembly is physically separated from the circuit board.

5. The system as recited in claim 1, wherein the lamp assembly is operative to be moved by a user of the lighting system without requiring the user to touch the reflector.

6. The system as recited in claim 1, wherein rotation of the focal adjustment ring about the optical axis causes the lamp traveler to carry the lamp assembly in a desired direction along the optical axis to facilitate the focal adjustment without rotation of the lamp assembly.

7. The system as recited in claim 1, wherein the focal adjustment ring is formed of an aluminum alloy.

8. The system as recited in claim 7, wherein the focal adjustment ring is anodized.

9. The system as recited in claim 1, wherein an inside surface of the focal adjustment ring forms one or more focal adjustment ring threads, wherein an outside surface of the lamp traveler forms one or more lamp traveler threads, and wherein the lamp traveler threads are mated with the focal adjustment ring threads so as to enable rotation of the focal adjustment ring relative to the lamp traveler.

10. The system as recited in claim 9, wherein the focal adjustment ring threads and the lamp traveler threads are quad-lead.

11. The system as recited in claim 1, wherein the focal adjustment ring includes one or more fans that protrude away from the reflector to prevent a user of the focal adjustment ring from coming into contact with the reflector.

12. The system as recited in claim 1, wherein the two or more arms are retained by the reflector so as to prevent the lamp traveler from rotating when the focal adjustment ring is rotated.

13. The system as recited in claim 12, wherein a first arm of the two or more arms has a first width and a second arm of the two or more arms has a second width, the first width being different than the second width, and wherein the reflector forms a first slot matching the first width and a second slot matching the second slot.

14. The system as recited in claim 1, further comprising an end cap for securing the lamp assembly within the lower body portion and facilitating removal or replacement of the lamp assembly.

15. The system as recited in claim 14, wherein the lamp assembly includes two spring loaded contacts protruding from an end of the lamp assembly, wherein the end cap forms a central rear opening, and wherein the end cap is positioned over the end and secured to the lower body portion so that the two spring loaded contacts protrude through the central real opening.

16. A focal adjustment system for use in a lighting system, comprising:

a lamp assembly including a lamp and an inductor coil;

a reflector in a fixed position, the reflector forming a through-hole for receiving the lamp;

a lamp traveler for holding the lamp assembly and operative to be moved parallel to an optical axis of the lighting system; and a focal adjustment ring positioned around a portion of the reflector for engaging with the lamp traveler and moving the lamp traveler when the focal adjustment ring is rotated about the reflector, wherein the lamp traveler includes an upper body portion for mating with the focal adjustment ring and a lower body portion for carrying the lamp assembly, the upper body portion being connected to the lower body by two or more arms.

17. The system as recited in claim 16, wherein the lighting system includes a ballast circuit having a circuit board, and wherein the circuit board is physically separated from the inductor coil.

* * * * *